US009180475B2

(12) United States Patent
Cho

(10) Patent No.: US 9,180,475 B2
(45) Date of Patent: Nov. 10, 2015

(54) LIQUID-CONTAINER EQUIPPED WITH ROTARY DISCHARGER

(75) Inventor: Sung-Hwan Cho, Seoul (KR)

(73) Assignee: Samhwa Plastic Ind., Co. (KR)

( * ) Notice: Subject to any disclaimer, the term of this patent is extended or adjusted under 35 U.S.C. 154(b) by 0 days.

(21) Appl. No.: 14/240,629

(22) PCT Filed: Apr. 18, 2012

(86) PCT No.: PCT/KR2012/002962

§ 371 (c)(1),
(2), (4) Date: Feb. 24, 2014

(87) PCT Pub. No.: WO2013/027912

PCT Pub. Date: Feb. 28, 2013

(65) Prior Publication Data

US 2014/0231464 A1 Aug. 21, 2014

(30) Foreign Application Priority Data

Aug. 24, 2011 (KR) ..... 10-2011-0084628

(51) Int. Cl.

| | |
|---|---|
| ***B05B 11/00*** | (2006.01) |
| ***B65D 83/00*** | (2006.01) |
| ***A45D 34/04*** | (2006.01) |
| *B65D 83/40* | (2006.01) |

(52) U.S. Cl.

CPC ..... *B05B 11/3056* (2013.01); *A45D 34/04* (2013.01); *B05B 11/0037* (2013.01); *B05B11/3004* (2013.01); *B05B 11/3023* (2013.01); *B05B 11/3052* (2013.01); *B65D 83/0033* (2013.01); *A45D 2200/055* (2013.01); *B05B 11/0027* (2013.01); *B05B 11/0048* (2013.01); *B05B 11/0064* (2013.01); *B05B 11/3057* (2013.01); *B05B 11/3074* (2013.01); *B65D 83/40* (2013.01)

(58) Field of Classification Search

CPC ..... B65D 83/40; B65D 83/0033; B05B 11/0048; B05B 11/3057; B05B 11/0037; B05B 11/0027; B05B 11/0064; B05B 11/3074; B05B 11/3023; B05B 11/3004; B05B 11/3056; A45D 34/04; A45D 2200/055

USPC ..... 222/321.8, 321.7, 256, 405, 182, 183

See application file for complete search history.

(56) References Cited

U.S. PATENT DOCUMENTS

| | | | | |
|---|---|---|---|---|
| 7,857,174 | B2 * | 12/2010 | Michaux et al. | 222/507 |
| 7,874,461 | B2 * | 1/2011 | Bae | 222/153.13 |
| 8,636,177 | B1 * | 1/2014 | Gardiner et al. | 222/192 |
| 8,695,852 | B2 * | 4/2014 | Bertin et al. | 222/153.13 |

FOREIGN PATENT DOCUMENTS

| | | |
|---|---|---|
| JP | 2008-056306 | 3/2008 |
| KR | 20-0427883 | 9/2006 |
| KR | 20-0439902 | 5/2008 |
| KR | 10-0908766 | 7/2009 |
| KR | 10-1049783 | 7/2011 |

* cited by examiner

*Primary Examiner* — Frederick C Nicolas

(74) *Attorney, Agent, or Firm* — The Farrell Law Firm, P.C.

(57) ABSTRACT

The present invention relates to a liquid-container equipped with a rotary discharger for discharging liquid whilst rotating. To this end, the present invention comprises: a main housing; a rotating shoulder section which is rotatably connected to the main housing; a moving cam section which is provided on the rotating shoulder section and which moves up/down in accordance with the rotation of the rotating shoulder section; a moving container section which is provided in the main housing, is connected to and moves with the moving cam section, and is provided with liquid therein; a pumping device section which is provided inside the moving cam section, and which both rotates the rotating shoulder section and moves the moving cam section up/down and thus causes the liquid to flow in or be discharged according to the pressure; a discharge cover section, which is connected to the pumping device section and has a discharge opening/closing section that opens and closes according to the pressure from the pumping device section; and an elastic member which is provided between the moving cam section and the discharge cover section, and which has an elasticity that allows the up/down movement of the moving cam.

9 Claims, 14 Drawing Sheets

LIQUID-CONTAINER EQUIPPED WITH ROTARY DISCHARGER

PRIORITY

This application is a National Stage application under 35 U.S.C. §371 of International Application No. PCT/KR2012/002962 filed Apr. 18, 2012, which claims priority under 35 U.S.C. §365(b) to Korean Patent Application No. 10-2011-0084628 filed Aug. 24, 2011, the content of each of which is incorporated herein by reference.

TECHNICAL FIELD

The present invention relates to a liquid case, and more particularly, to a liquid case having a rotary discharging apparatus for discharging liquid by rotation.

BACKGROUND ART

In general, cosmetic products are categorized into cold cream, massage cream, and nourishing cream depending on their usages and these creams are all liquid.

A user is supposed to take some of such a cosmetic product from a vessel with a finger and apply it to the user's skin. After using the cosmetic product, the user closes the lid of the vessel by turning the lid.

Since the user puts a finger on the liquid, foreign materials are likely to be introduced into the vessel, thereby spoiling the liquid.

To solve the above problem, a tube-type vessel with a pressing pump has been developed, which discharges a certain amount of liquid by pressing.

The pressing pump is installed on a nozzle cap to open or close the inlet of the tube-type vessel. When a button of the pressing pump is pressed with a finger, the interior of the vessel gets vacuum by the pressure and the contents of the vessel are discharged through the nozzle with a certain amount each time due to the vacuum pressure.

The structure of a liquid cosmetics vessel with the pressing pump is disclosed in Korea Patent Registration No. 10-0949320 (Mar. 17, 2010).

However, a cosmetics vessel with the conventional pressing pump requires a plurality of button pressings, for discharging its contents. The resulting abrasion or contraction of the pump decreases air tightness. Therefore, foreign materials may be introduced into the cosmetics vessel, spoiling the cosmetic liquid and a pumping function may not work well.

Accordingly, there is a need for a device configured to discharge a cosmetic liquid by rotation, not pressing.

DISCLOSURE

Technical Problem

An aspect of the present invention is to provide a liquid case having a rotary discharging apparatus that is configured to discharge liquid by rotation of a rotary shoulder unit, for facilitating liquid discharge.

Another aspect of the present invention is to provide a liquid case having a rotary discharging apparatus configured to control the amount of liquid discharge by controlling rotation of a rotary shoulder unit so that a user may take an intended amount of liquid.

Technical Solution

The object of the present invention can be achieved by providing a liquid case having a rotary discharging apparatus.

The liquid case includes a body housing, a rotary shoulder unit rotatably engaged with the body housing, a moving cam unit provided in the rotary shoulder unit, for moving up and down along with rotation of the rotary shoulder unit, a moving case unit provided in the body housing and engaged with the moving cam unit, for moving together with the moving cam unit and containing a liquid, a pumping device provided in the moving cam unit, for introducing or discharging the liquid according to pressure by rotating the rotary shoulder unit and moving up or down the moving cam unit, a discharge cover unit engaged with the pumping device and having a discharge opener for being opened or closed according to pressure of the pumping device, and an elastic member interposed between the moving cam unit and the discharge cover unit, for providing elastic force to enable upward and downward movement of the moving cam unit.

An accommodate space may be formed inside the body housing to accommodate the moving case unit and movably engage the moving case unit with the body housing.

The rotary shoulder unit may include a cover and an inclined guide. The cover has a hinge and rotatably engaged by the hinge and is provided at an upper part of the rotary shoulder unit, for opening or closing the discharger cover unit. The rotary shoulder unit may adjust a discharged amount of the liquid by controlling rotation and upward and downward movement of the moving cam unit.

The inclined guide may be provided in the rotary shoulder unit, for guiding a pair of cams formed in the moving cam unit to rotatably move the pair of cams.

The moving cam unit may include an engagement hole, a screw engagement portion, a pair of cams, and a guide groove. The engagement hole may be formed at a center of the moving cam unit, for allowing the pumping device to be inserted therein and being engaged with the pumping device. The screw engagement portion may be formed in the engagement hole, for being engaged with a screw portion formed in the moving case unit. The pair of cams may be formed around the engagement hole, for being engaged with the inclined guide and moving up and down by guidance of the inclined guide during rotation of the rotary shoulder unit. The guide groove may be formed around the engagement hole, for being engaged with a guide protrusion formed in the discharge cover unit and guiding upward and downward movement of the moving cam unit.

The moving case unit may include a case body, a screw portion, an engagement portion, a piston portion, and a case lid. The case body may have an opening opened in one direction. The screw portion may be formed at an upper part of the case body, for being screw-engaged with a screw portion of the mobbing cam unit. The engagement portion may be formed in the screw portion, for being engaged with the pumping device. The piston unit may be provided in the case body, for introducing the liquid into the pumping device by moving up and down. The case lid may be provided under the case body to support the liquid within the moving case unit and the piston unit. The case body may include at least one stopper engaged with a plurality of stopper protrusions formed in the moving cam unit, for, when the moving cam unit moves up or down by rotation of the rotary shoulder unit, preventing deviation of the moving cam unit from the case body.

The pumping device may include an inlet and an outlet. The inlet may be formed in a lower part of the pumping device, for introducing the liquid from the moving case unit to the pumping device, and the outlet may be formed in an upper part of the pumping device, for discharging the liquid from the pumping device by pressure.

The discharge cover unit includes a cover engagement portion, a discharger, and a discharge opener. The cover engagement portion may be formed on a bottom surface of the discharge cover unit, for being screw-engaged with a screw hole formed in the pumping device. The discharger may be formed in the discharge cover unit. The discharger opener may be provided in the discharger, for opening or closing the discharger according to an operation of the pumping device, preventing the liquid from rising above a top surface of the discharge cover unit, and flowing the liquid sideways on the discharge cover unit.

In another aspect of the present invention, there is provided a liquid case having a rotary discharging apparatus. The liquid case includes a body housing, a rotary shoulder unit rotatably engaged with the body housing, a moving cam unit provided in the rotary shoulder unit, for moving up and down along with rotation of the rotary shoulder unit, a moving case unit provided in the body housing and engaged with the moving cam unit, for moving together with the moving cam unit and containing a liquid, and a pumping device provided in the moving cam unit, for introducing or discharging the liquid according to pressure by rotating the rotary shoulder unit and moving up or down the moving cam unit.

Advantageous Effects

The liquid case having a rotary discharging apparatus according to the present invention is configured so as to discharge liquid by rotation, not by pressing. Therefore, liquid discharge is facilitated. In addition, the liquid case having a rotary discharging apparatus is configured so as to control the amount of discharged liquid by controlling rotation of a rotary shoulder unit, so that a user may take an intended amount of liquid.

DESCRIPTION OF DRAWINGS

The accompanying drawings, which are included to provide a further understanding of the invention, illustrate embodiments of the invention and together with the description serve to explain the principle of the invention.

In the drawings.

BEST MODE

Reference will now be made in detail to the preferred embodiments of the present invention, examples of which are illustrated in the accompanying drawings. A description of well-known components will be avoided lest it should obscure the subject matter of the present invention.

FIGS. 1 to 14 illustrate the configuration and operation state of a liquid case having a rotary discharging apparatus 10 according to the present invention.

Figure 1:
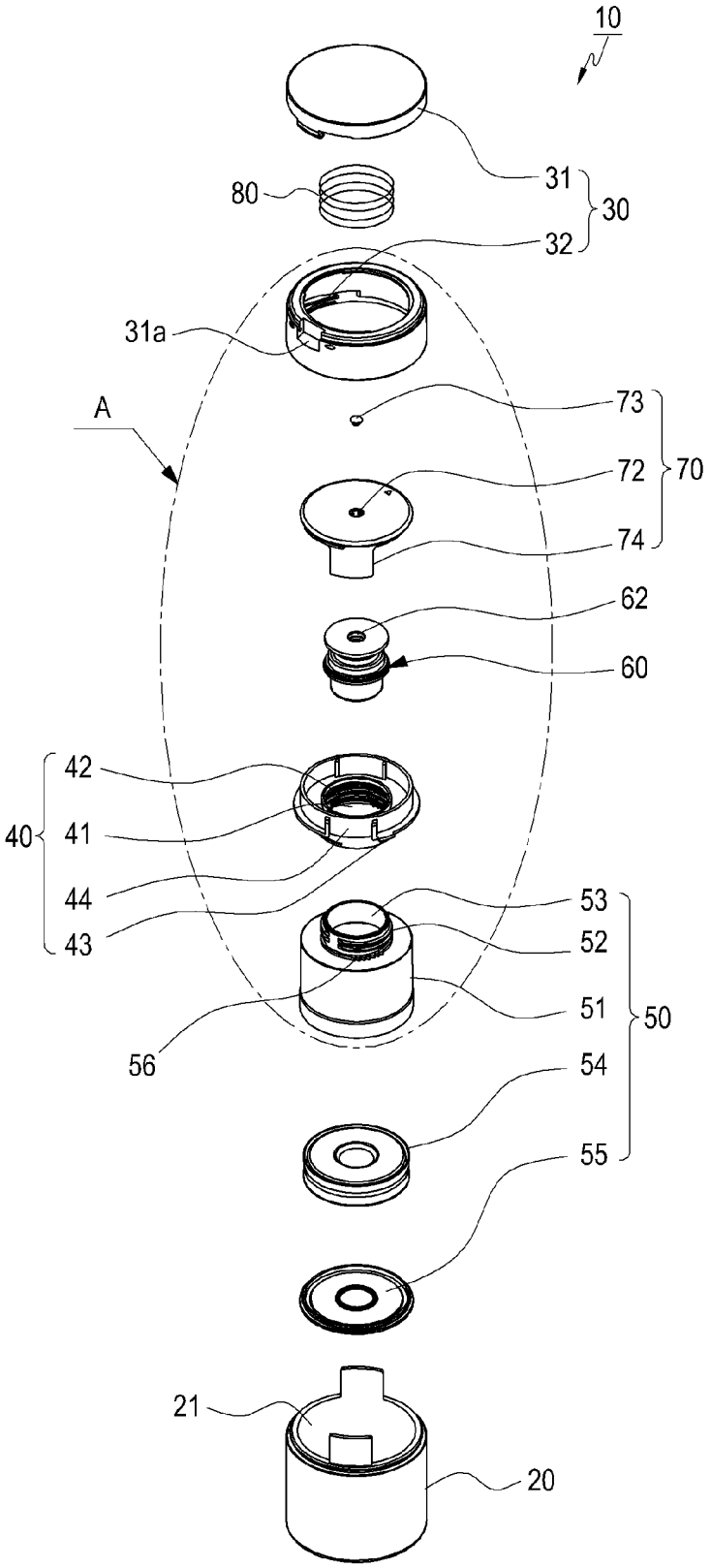
FIG. 1 is an exploded perspective view of a liquid case having a rotary discharging apparatus according to a preferred embodiment of the present invention.
Figure 2:
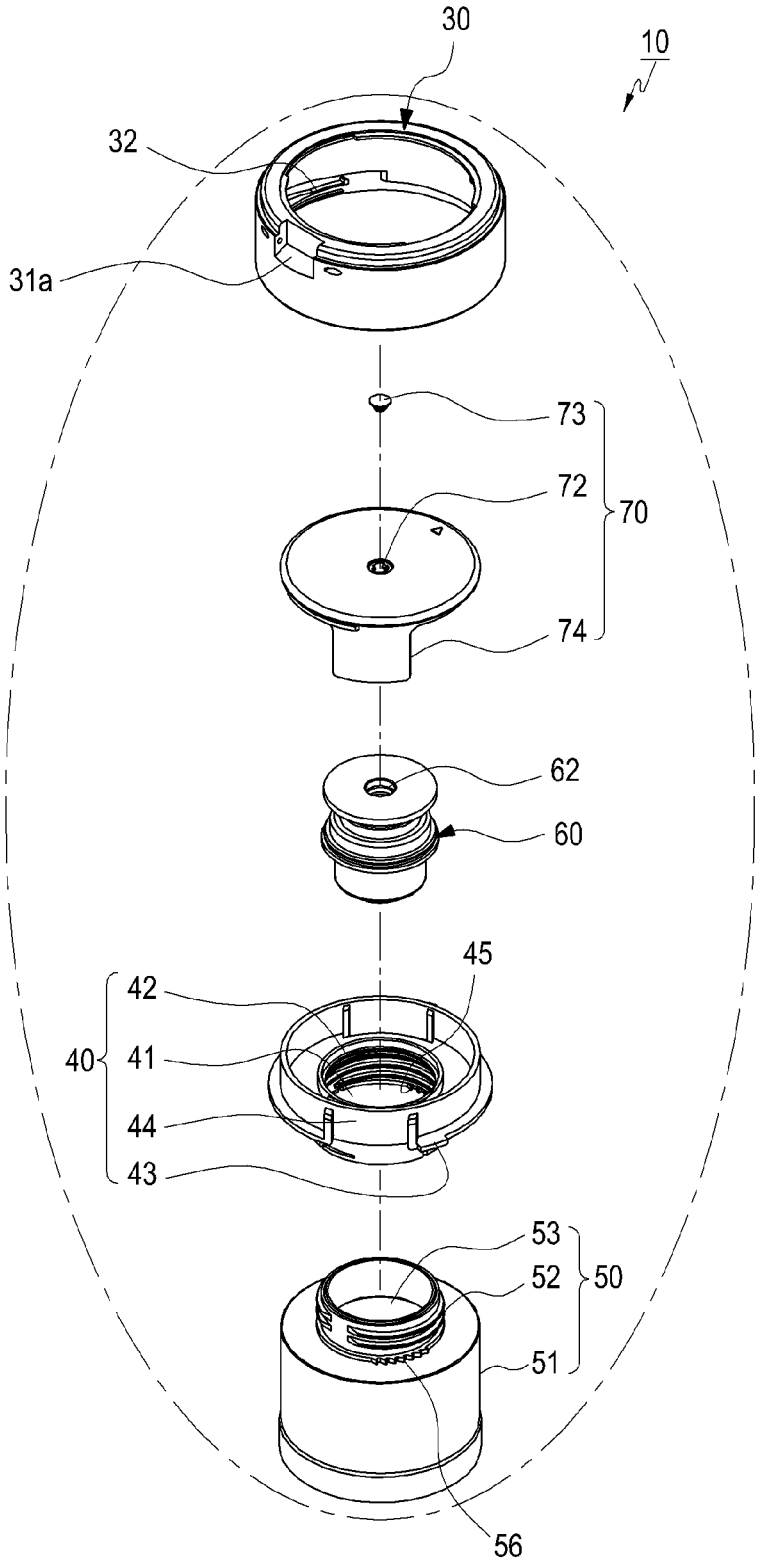
FIG. 2 is an exploded perspective view enlarging a part A illustrated in FIG. 1.

Referring to FIGS. 1 and 2, the rotary discharging apparatus 10 includes a body housing 20, a rotary shoulder unit 30 rotatably engaged with the body housing 20, a moving cam unit 40 that moves up and down along with rotation of the rotary shoulder unit 30, a moving case unit 50 provided in the body housing 20 and engaged with the moving cam unit 40, for moving together with the moving cam unit 40 and accommodating a liquid A1 (see FIG. 14), a pumping device 60 that moves the moving cam unit 40 up and down, rotating the rotary shoulder unit 30 and thus introducing or discharging the liquid A1 by pressure, a discharge cover unit 70 engaged with pumping device 60 and having a discharge opener that is opened or closed according to the pressure of the pumping device 60, and an elastic member 80 interposed between the moving cam unit 40 and the discharge cover unit 70, for providing elastic force to enable upward and downward movement of the moving cam unit 40.

Figure 6:
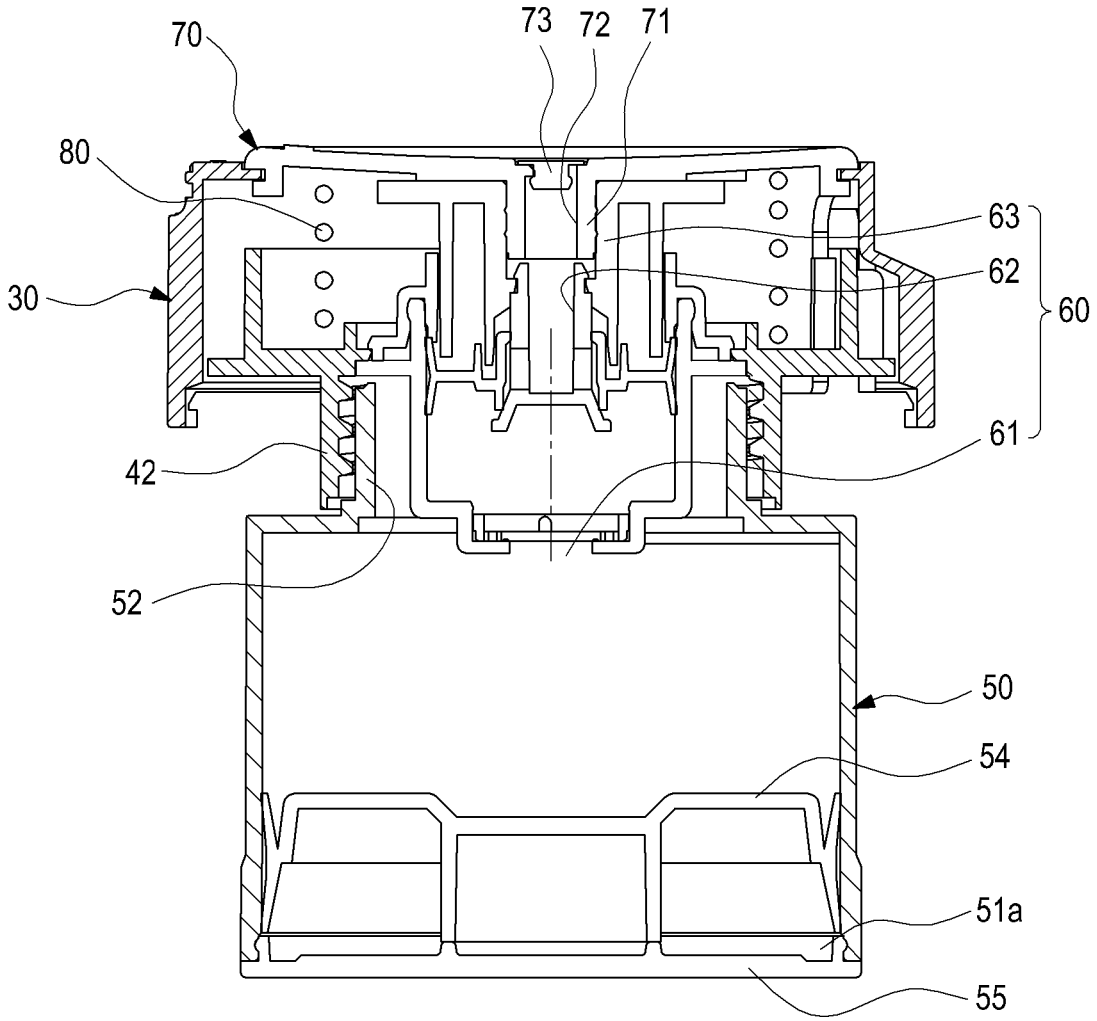
FIG. 6 is a side sectional view of an engaged state among the rotary shoulder unit, the moving cam unit, the pumping device, and a moving case unit in the liquid case having the rotary discharging apparatus according to the preferred embodiment of the present invention.

Referring to FIGS. 1 and 6, the moving case unit 50 including a piston unit 54 and a case lid 55 is accommodated in the body housing 20. The moving cam unit 40 is screwed on the moving case unit 50. The pump device 60 is inserted and engaged with the moving cam unit 40. The discharge cover unit 70 is screwed on the top surface of the pumping device 60. The rotary shoulder unit 30 is rotatably engaged with the top of the body housing 20. The elastic member 80 is interposed between the moving cam unit 40 and the discharge cover unit 70.

A case body 51 of the later-described moving case unit 50 is provided with one or more stoppers 56 (see FIGS. 1 and 2) that are engaged with a plurality of stopper protrusions 45 formed in the moving cam unit 40 and, when the moving cam unit 40 moves up and down along with rotation of the rotary shoulder unit 30, prevent the moving cam unit 40 from leaving from the case body 51. The stoppers 56 prevent the moving cam unit 40 from loosening or detaching due to vibrations during rotation of the rotary shoulder unit 30.

Figure 7:
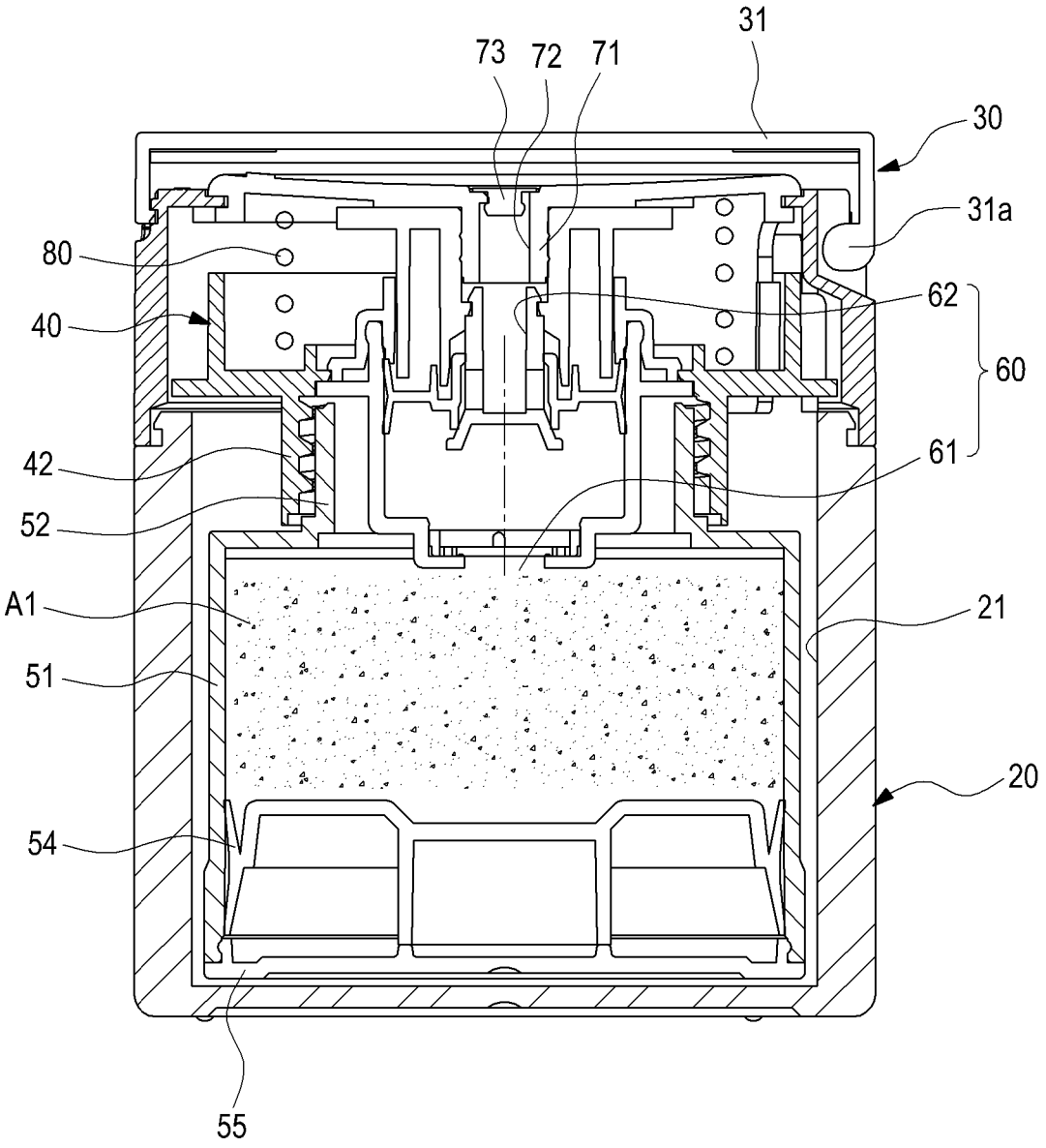
FIG. 7 is a side sectional view of an engaged state of the liquid case having the rotary discharging apparatus according to the preferred embodiment of the present invention.
Figure 8:
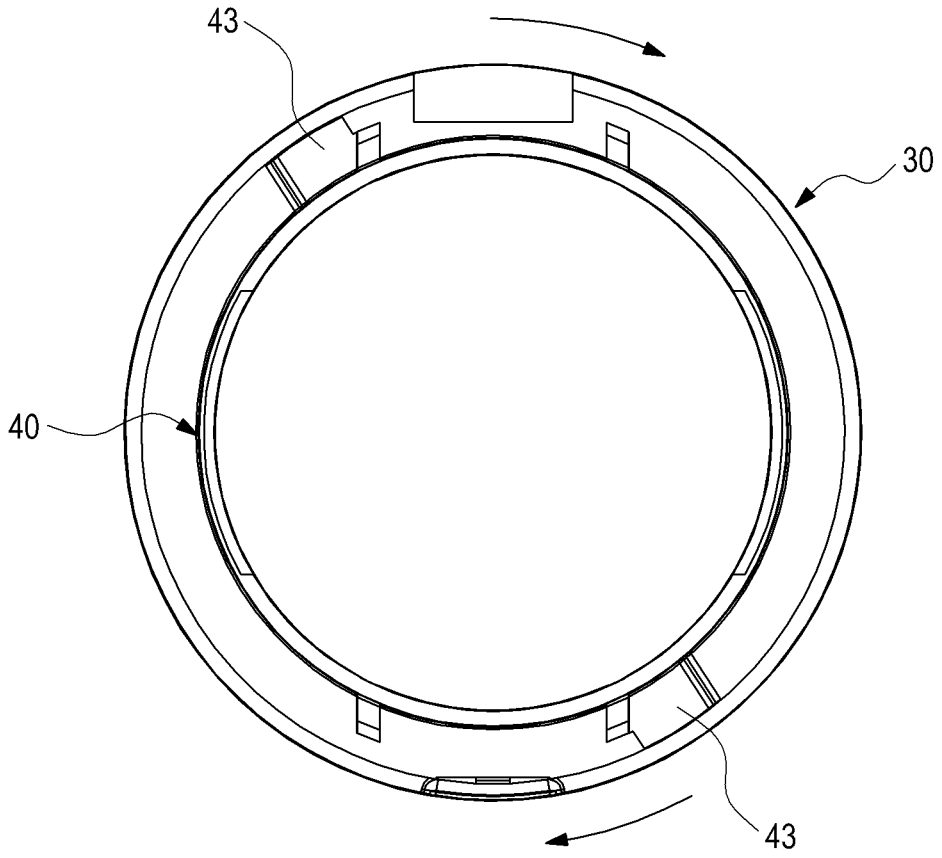
FIG. 8 is a plan view of a pre-operation state of the liquid case having the rotary discharging apparatus according to the preferred embodiment of the present invention.
Figure 9:
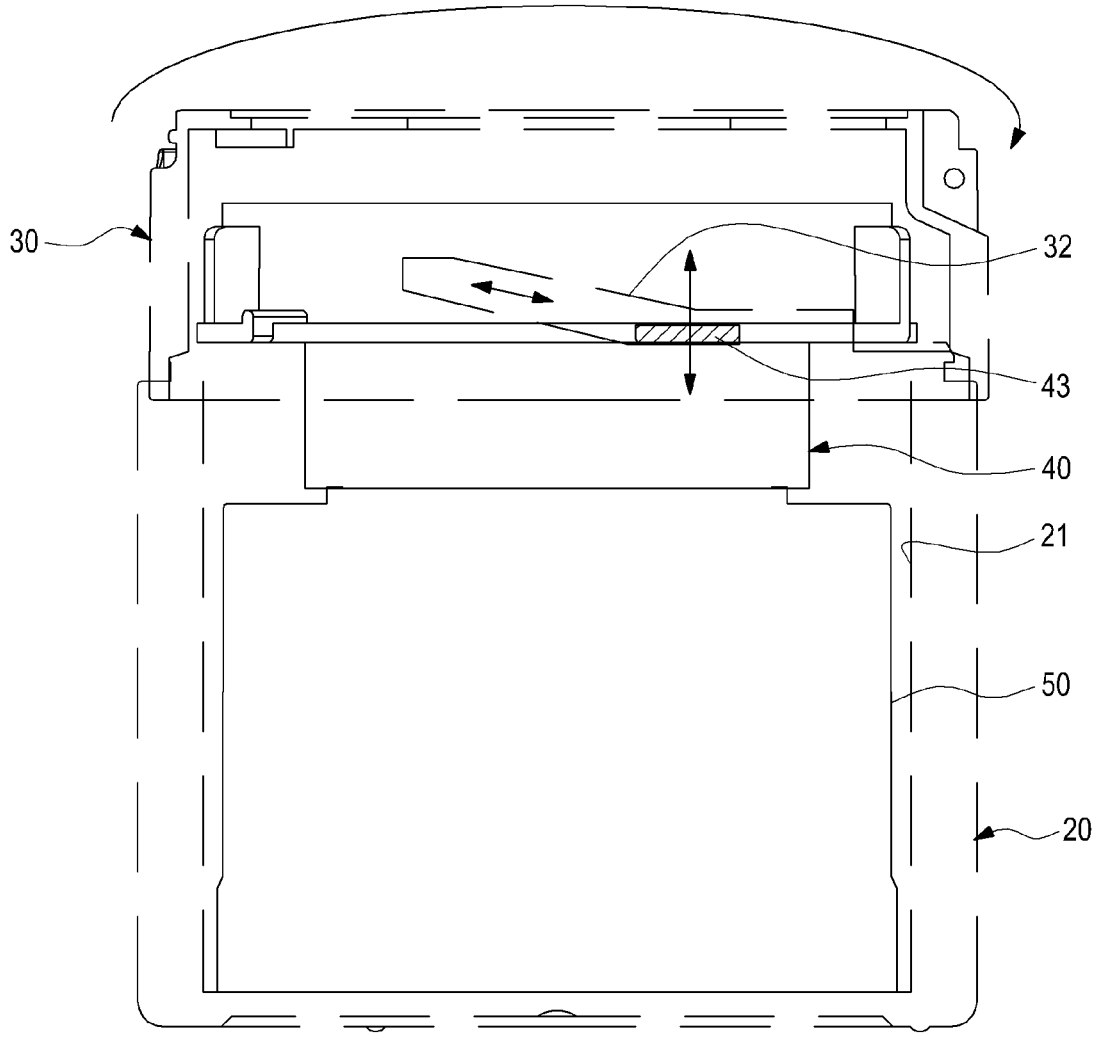
FIG. 9 is a side view of the pre-operation state of the liquid case having the rotary discharging apparatus according to the preferred embodiment of the present invention.

If a user discharges the liquid A1 from the moving case unit 50 in this state, since the rotary shoulder unit 30 includes a cover 31 and an inclined guide 32 and the cover 31 is rotatably engaged with a hinge 31*a* (see FIG. 14) of the rotary shoulder unit 30 as illustrated in FIG. 7, the cover 31 is rotated by the hinge 31*a*. FIGS. 8 and 9 illustrate a pre-rotation state of the rotary shoulder unit 30. Referring to FIGS. 8 and 9, because the inclined guide 32 is provided in the rotary shoulder unit 30 to rotatably guide a pair of cams 43 formed in the moving cam unit 40, when the rotary shoulder unit 30 rotates, the inclined guide 32 is also rotated, moving up and down the pair of cams 43.

Figure 3:
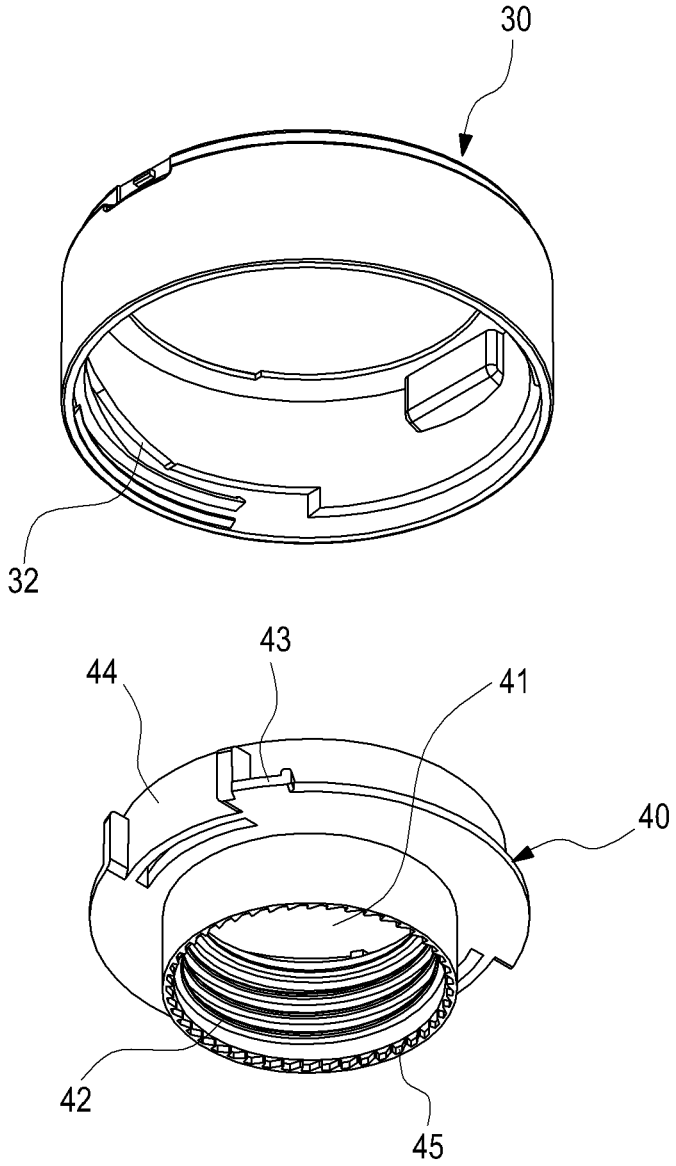
FIG. 3 is an exploded perspective view of a rotary shoulder unit and a moving cam unit in the liquid case having the rotary discharging apparatus according to the preferred embodiment of the present invention.
Figure 4:
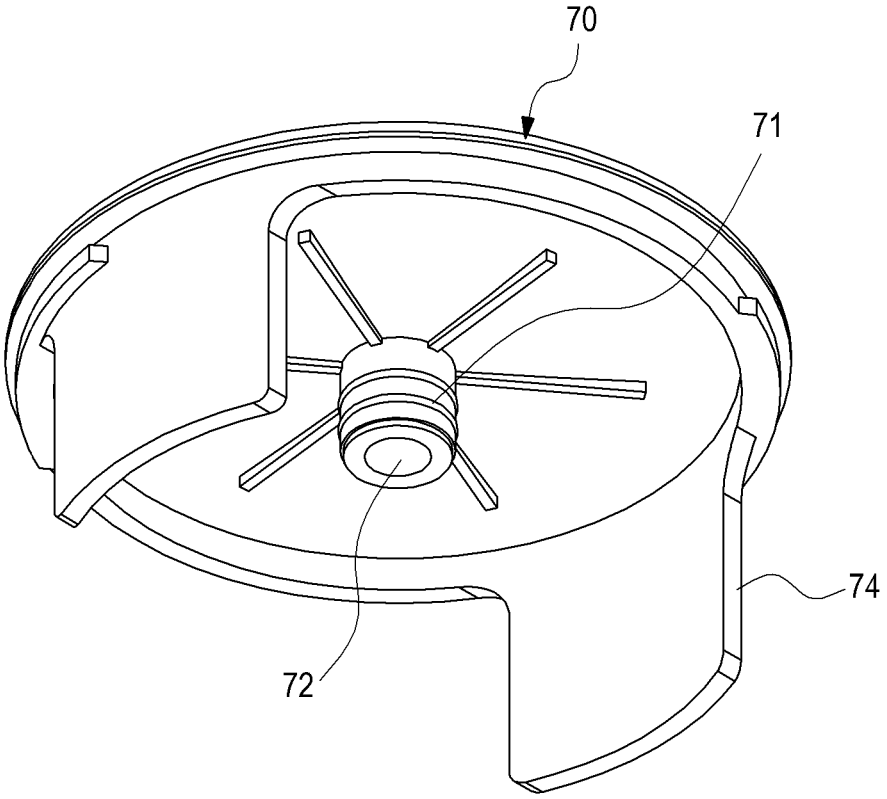
FIG. 4 is a perspective view of a discharge cover unit in the liquid case having the rotary discharging apparatus according to the preferred embodiment of the present invention.
Figure 5:
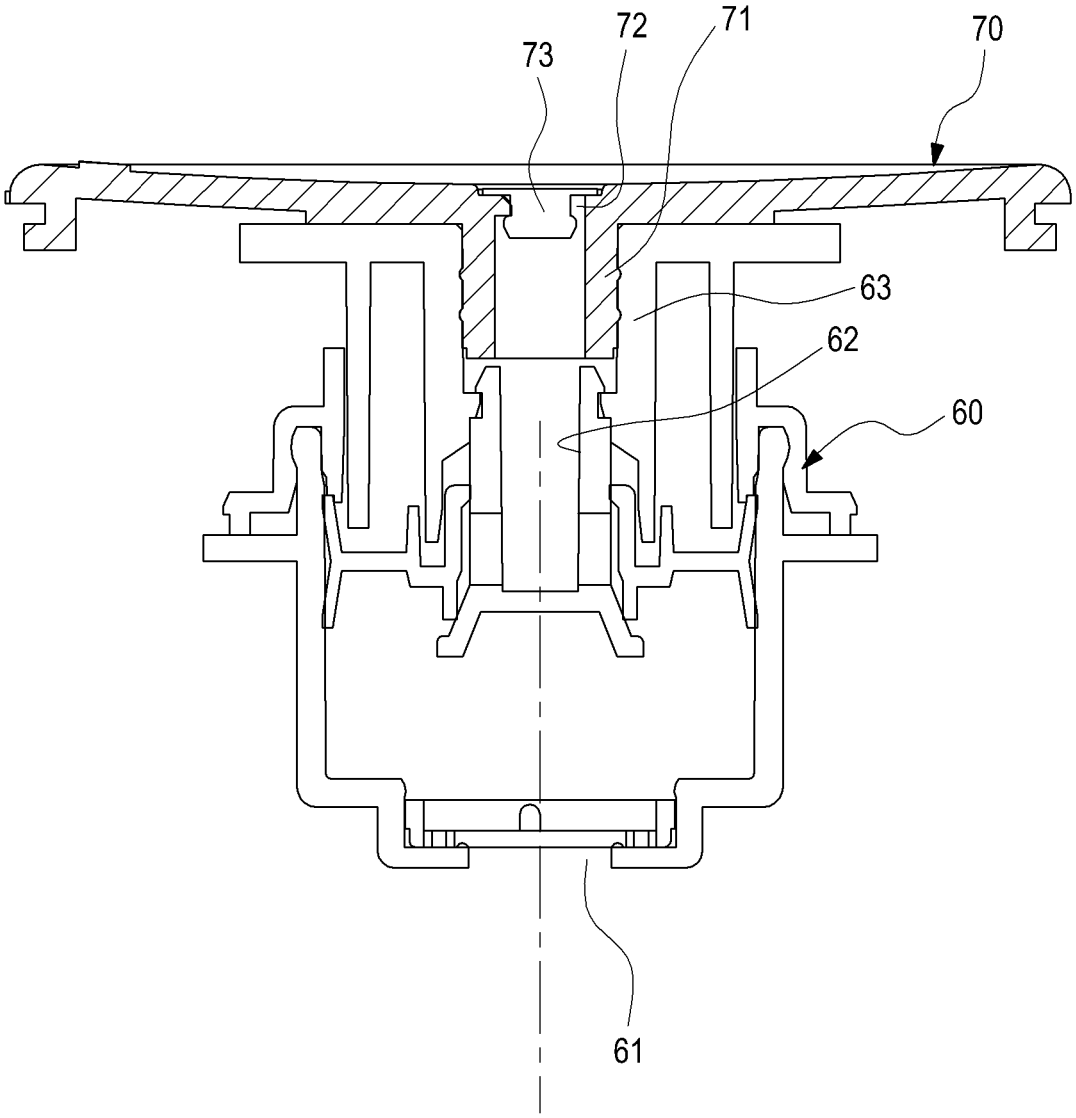
FIG. 5 is a side sectional view of an engaged state between the discharge cover unit and a pumping device in the liquid case having the rotary discharging apparatus according to the preferred embodiment of the present invention.
Figure 10:
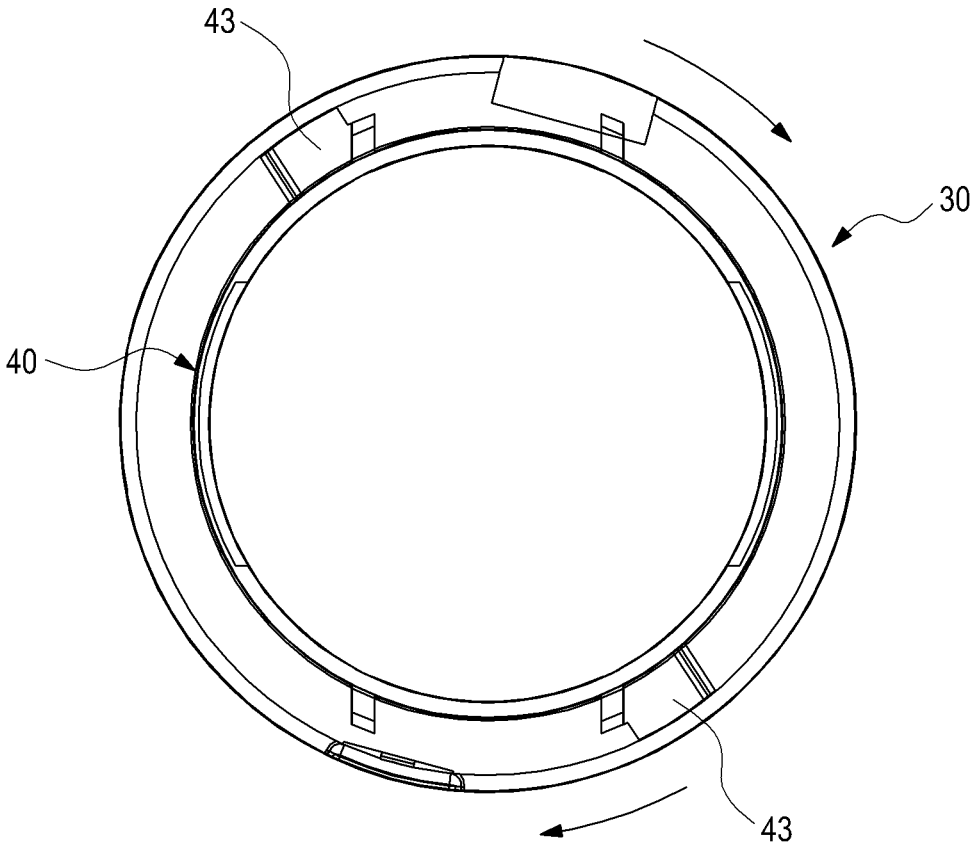
FIG. 10 is a plan view of an operation of the liquid case having the rotary discharging apparatus according to the preferred embodiment of the present invention.
Figure 11:
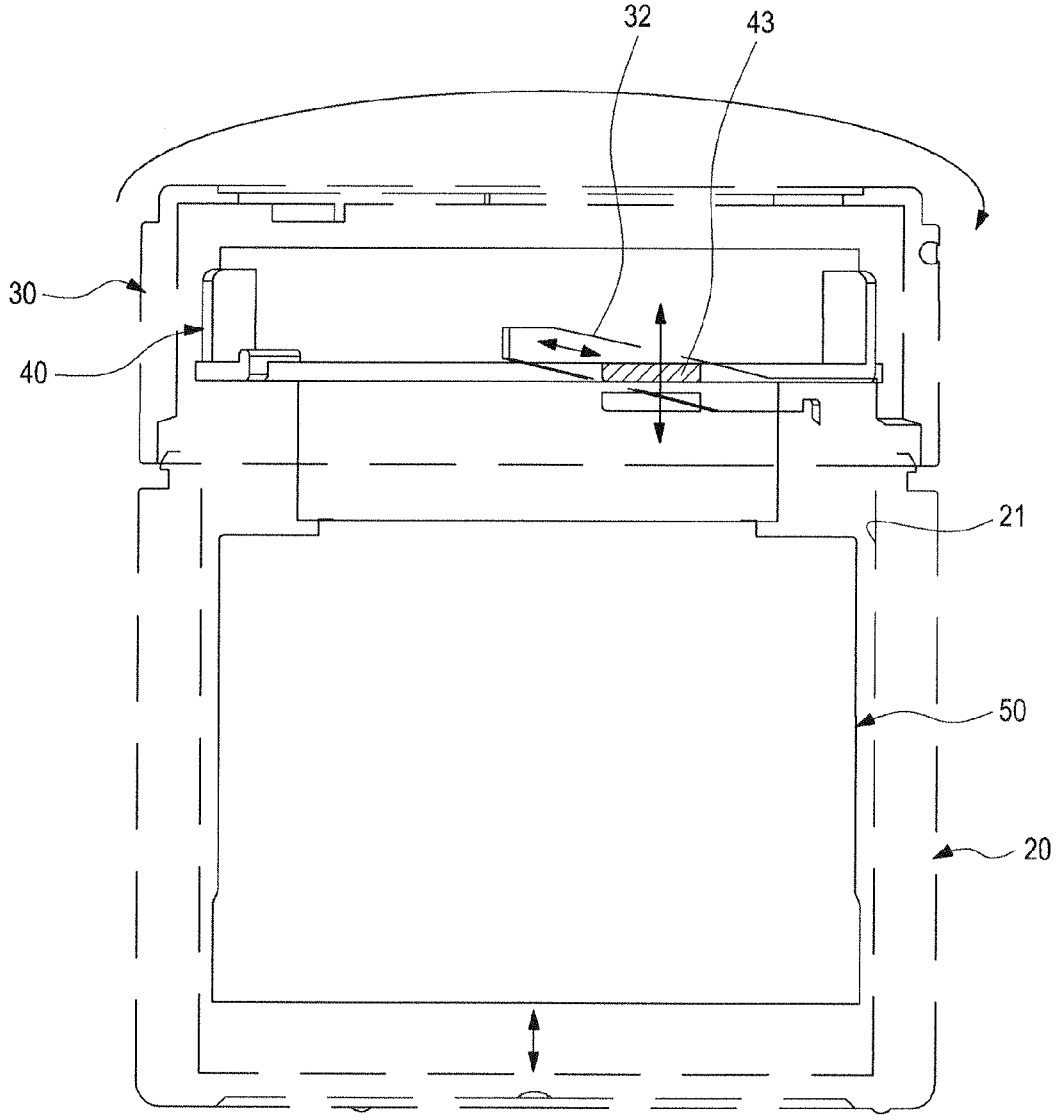
FIG. 11 is a side view of the operation of the liquid case having the rotary discharging apparatus according to the preferred embodiment of the present invention.

Referring to FIG. 3, the moving cam unit 40 includes an engagement hole 41, a screw engagement portion 42, the one pair of cams 43, and a guide groove 44. As illustrated in FIGS. 10 and 11, the pair of cams 43 are configured to move up and down under the guidance of the inclined guide 32. Therefore, if the rotary shoulder unit 30 rotates, the cams 43 are moved up and down by the inclined guide 32. Since the screw engagement portion 42 is engaged with a screw unit 52 (see FIG. 14) formed in the moving case unit 50, the moving case unit 50 moves up along with upward movement of the moving cam unit 40. In addition, the guide groove 44 is formed in the moving cam unit, in engagement with a guide protrusion 74 formed in the discharge cover unit 70 in order to guide upward and downward movement of the moving cam unit 40. Thus the guide groove 44 is engaged with the guide protrusion 74, thereby guiding upward and downward movement of the moving cam unit 40.

Figure 12:
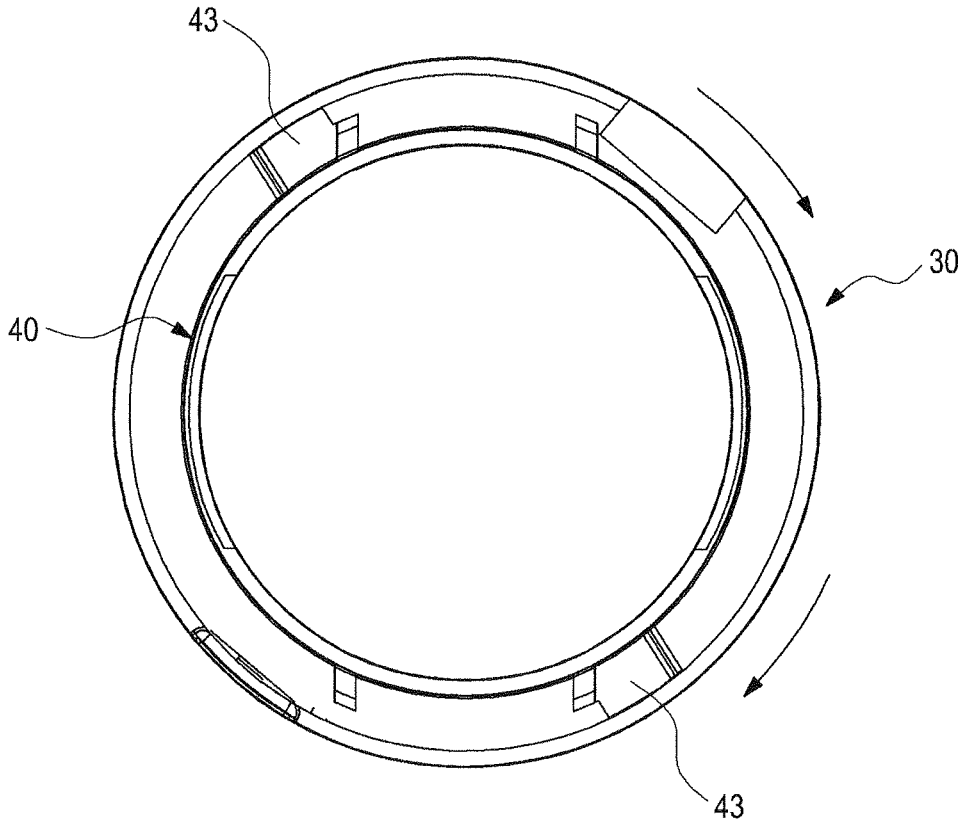
FIG. 12 is a plan view of a post-operation state of the liquid case having the rotary discharging apparatus according to the preferred embodiment of the present invention.
Figure 13:
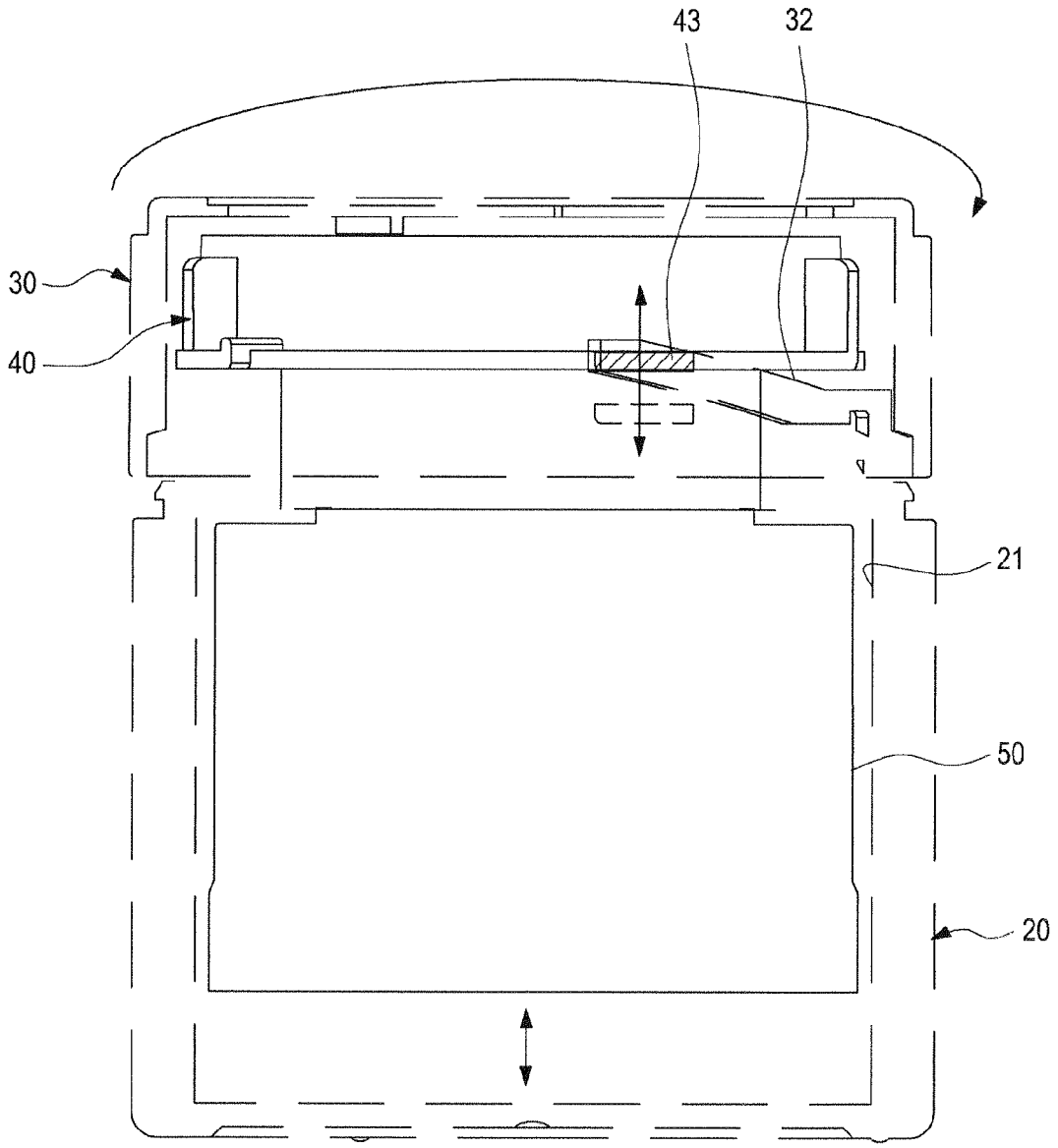
FIG. 13 is a side view of the post-operation state of the liquid case having the rotary discharging apparatus according to the preferred embodiment of the present invention.
Figure 14:
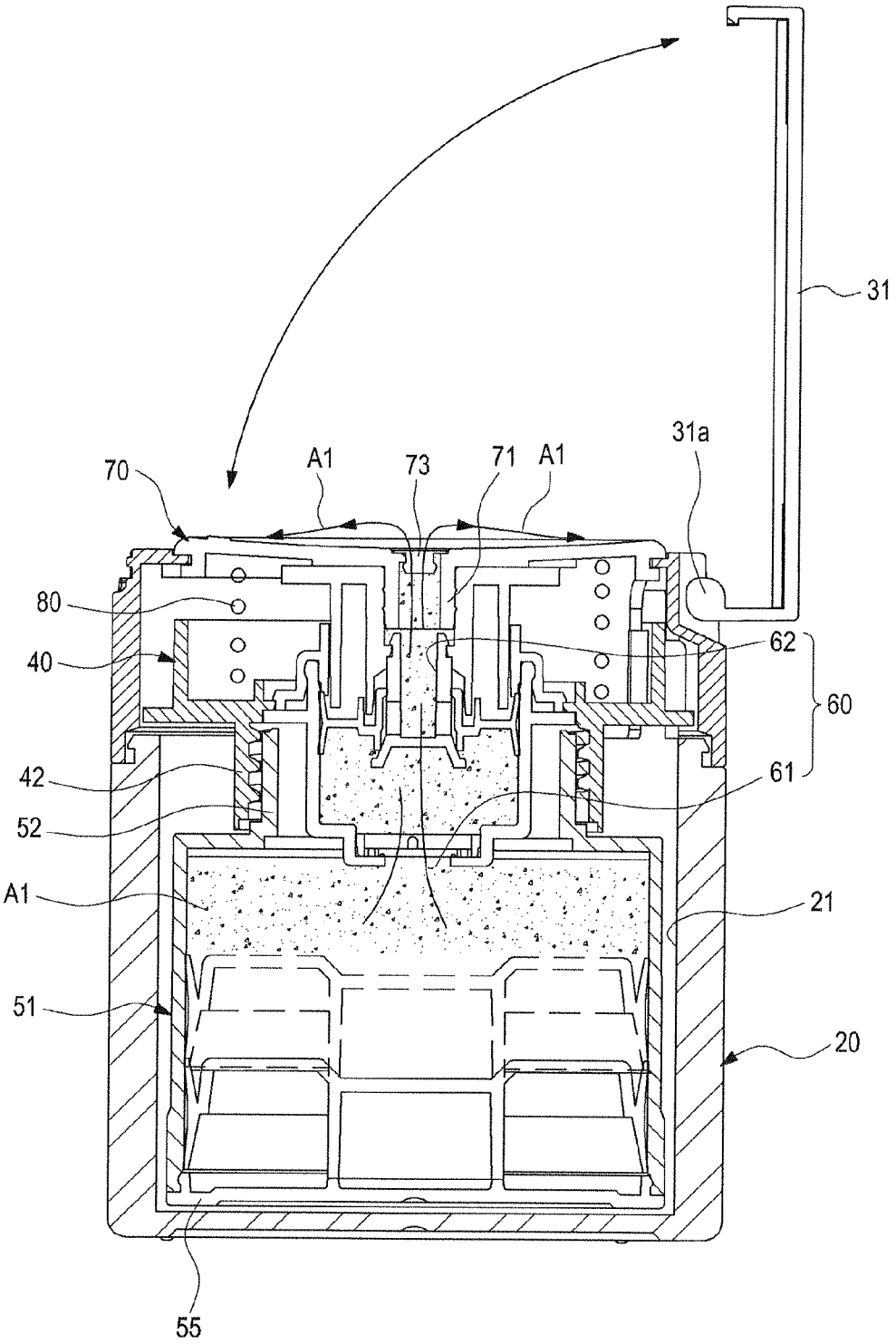
FIG. 14 is a side sectional view of an operation state of the liquid case having the rotary discharging apparatus according to the preferred embodiment of the present invention.

As illustrated in FIGS. 2 and 6, the moving case unit 50 includes the case body 51 with an opening 51 a opened in one direction, the screw unit 52, an engagement portion 53, the piston unit 54, and the case lid 55. Referring to FIGS. 12, 13, and 14, when the moving cam unit 40 and the moving case unit 50 move up by rotation of the rotary shoulder unit 30, the liquid A1 contained in the moving case unit 50 is also moved up and introduced into an inlet 61 of the pumping device 60. Referring to FIG. 14, the liquid A1 is introduced into the inlet 61 of the pumping device 60 and then discharged through an outlet 62 of the pumping device 60 by pressure of the pumping device 60. The discharged liquid A1 moves to a discharger 72 of the discharge cover unit 70, opens a discharge opener 73 of the discharge cover unit 70, and then goes out. The discharge opener 73 is provided in the discharger 72 to open or close according to pressure of the pumping device 60. Therefore, the discharge opener 73 is opened by the pressure of the pumping device 60 and discharges the liquid A1 to the outside. Further, the discharge opener 73 prevents the discharged liquid A1 from rising from the top surface of the discharge cover unit 70, while flowing the liquid A1 sideways on the discharge cover unit 70 so that the liquid A1 may stay on the discharge cover unit 70.

The cover engagement portion 53 (see FIGS. 4 and 5) is formed under the bottom surface of the discharge cover unit 70, to be screwed with the screw hole 63 formed in the pumping device 60. Therefore, the cover engagement portion 53 is screwed with the screw hole 63 formed in the pumping device 60 and transfers the liquid A1 (see FIG. 14) discharged from the pumping device 60 to the discharge cover unit 70.

If the user discharges the liquid A1 from the moving case unit 50 and rotates the rotary shoulder unit 30 reversely, since the elastic member 80 is provided between the moving cam unit 40 and the discharge cover unit 70 to provide elastic force that enables upward and downward movement of the moving cam unit 40, the elastic member 80 returns the moving cam unit 40 to the original position by moving down the moving cam unit 40. Herein, the piston unit 54 is kept raised in the moving case unit 50 to discharge the liquid A1 through the pumping device 60. The cams 43 of the moving cam unit 40 are guided down to the original positions along the inclined guide 32 of the rotary shoulder unit 30.

The discharge opener 73 formed in the discharge cover unit 70 closes the discharger 72 of the discharge cover unit 70. Therefore, the liquid A1 is blocked from being discharging from the moving case unit 50.

As described above, as the rotary shoulder unit 30 rotates, the moving cam unit 40 and the moving case unit 50 move up and down to thereby discharge the liquid to the outside. Therefore, discharge of the liquid can be facilitated and product use convenience can be increased.

Furthermore, the rotary shoulder unit 30 controls upward and downward movement of the moving cam unit 40, while controlling its rotation. Consequently, the amount of discharged liquid A1 is controlled so that the user may take an intended amount of the liquid A1.

While it has been described above that the present invention is applied to the afore-described liquid case by way of example, the rotary discharging apparatus 10 is not limited to the specific liquid case. Thus, the rotary discharging apparatus 10 is applicable to all liquid cases of various types (for example, a tube, a shampoo container, a detergent vessel, and the like).

It will be apparent to those skilled in the art that the liquid case having the rotary discharging apparatus according to the present invention is not limited to the above-described embodiment and drawings and various modifications and variations can be made in the present invention without departing from the spirit or scope of the invention. Thus, it is intended that the present invention cover the modifications and variations of this invention provided they come within the scope of the appended claims and their equivalents.

The invention claimed is:

1. A liquid case having a rotary discharging apparatus, the liquid case comprising:

a body housing;

a rotary shoulder unit rotatably engaged with the body housing;

a moving cam unit provided in the rotary shoulder unit, for moving up and down along with rotation of the rotary shoulder unit;

a moving case unit provided in the body housing and engaged with the moving cam unit, for moving together with the moving cam unit and containing a liquid;

a pumping device provided in the moving cam unit, for introducing or discharging the liquid according to pressure by rotating the rotary shoulder unit and moving up or down the moving cam unit;

a discharge cover unit engaged with the pumping device and having a discharge opener for being opened or closed according to pressure of the pumping device; and an elastic member interposed between the moving cam unit and the discharge cover unit, for providing elastic force to enable upward and downward movement of the moving cam unit.

2. The liquid case according to claim 1, wherein an accommodation space is formed inside the body housing to accommodate the moving case unit and movably engage the moving case unit with the body housing.

3. The liquid case according to claim 1, wherein the rotary shoulder unit comprises:

a cover having a hinge in the rotary shoulder unit and rotatably engaged by the hinge, for opening or closing the discharge cover unit; and an inclined guide for guiding a pair of cams formed in the moving cam unit to rotatably move the pair of cams.

4. The liquid case according to claim 1, wherein the rotary shoulder unit adjusts a discharged amount of the liquid by controlling rotation and up and down movement of the moving cam unit.

5. The liquid case according to claim 1, wherein the moving cam unit comprises:

an engagement hole formed at a center of the moving cam unit, for allowing the pumping device to be inserted therein;

a screw engagement portion formed in the engagement hole, for being engaged with a screw portion formed in the moving case unit;

a pair of cams formed around the engagement hole, for being engaged with an inclined guide and moving up and down by guidance of the inclined guide during rotation of the rotary shoulder unit; and a guide groove formed around the engagement hole, for being engaged with a guide protrusion formed in the discharge cover unit and guiding up and down movement of the moving cam unit.

6. The liquid case according to claim 1, wherein the moving case unit comprises:

a case body having an opening opened in one direction;

a screw portion formed at an upper part of the case body, for being screw-engaged with a screw portion of the moving cam unit;

an engagement portion formed in the screw portion, for being engaged with the pumping device;

a piston unit provided in the case body, for introducing the liquid into the pumping device by moving up and down; and a case lid provided under the case body.

7. The liquid case according to claim 6, wherein the case body comprises at least one stopper engaged with a plurality of stopper protrusions formed in the moving cam unit, for, when the moving cam unit moves up or down by rotation of the rotary shoulder unit, preventing deviation of the moving cam unit from the case body.

8. The liquid case according to claim 1, wherein the pumping device comprises:

an inlet formed in a lower part of the pumping device, for introducing the liquid from the moving case unit to the pumping device; and an outlet formed in an upper part of the pumping device, for discharging the liquid from the pumping device by pressure.

9. The liquid case according to claim 1, wherein the discharge cover unit comprises:

a cover engagement portion formed on a bottom surface of the discharge cover unit, for being screw-engaged with a screw hole formed in the pumping device;

a discharger formed in the discharge cover unit; and a discharger opener provided in the discharger, for opening or closing the discharger according to an operation of the pumping device, to prevent the liquid from rising above a top surface of the discharge cover unit, and causing the liquid to flow sideways on the discharge cover unit.

* * * * *